United States Patent [19]

Lauton et al.

[11] 4,120,647

[45] Oct. 17, 1978

[54] PROCESS FOR THE DYEING OF WOOL-CONTAINING FIBRE MATERIALS

[75] Inventors: Alain Lauton, Saint-Louis, France; Hans-Ulrich Berendt, Allschwil, Switzerland

[73] Assignee: Ciba-Geigy Corporation, Ardsley, N.Y.

[21] Appl. No.: 799,908

[22] Filed: May 23, 1977

[30] Foreign Application Priority Data

Jun. 4, 1976 [CH] Switzerland ..... 7114/76
Sep. 21, 1976 [CH] Switzerland ..... 11934/76

[51] Int. Cl.[2] ..... D06P 5/00; D06P 3/16; D06P 1/645; D06M 3/02

[52] U.S. Cl. ..... 8/17; 8/133; 8/54; 8/88; 8/86; 8/21 B; 8/21 C

[58] Field of Search ..... 8/17, 54, 88, 133, 18 R, 8/21 C

[56] References Cited

U.S. PATENT DOCUMENTS

| | | | |
|---|---|---|---|
| 1,693,926 | 12/1928 | Horsfall et al. | 8/54 |
| 2,422,586 | 6/1947 | Royer et al. | 8/43 |
| 2,869,969 | 1/1959 | Schulze | 8/21 C |
| 3,142,529 | 7/1964 | Freyermuth et al. | 8/54 |
| 3,153,003 | 10/1964 | O'Brien | 8/127.6 |
| 3,181,927 | 5/1965 | Roth | 8/18 R |
| 3,232,692 | 2/1966 | Wilhelm et al. | 8/18 R |
| 3,294,476 | 12/1966 | Krusche et al. | 8/37 |
| 3,416,873 | 12/1968 | Fono et al. | 8/18 R |
| 3,576,591 | 4/1971 | Cusano et al. | 8/17 |

FOREIGN PATENT DOCUMENTS

| | | | |
|---|---|---|---|
| 147,938 | 9/1950 | Australia | 8/133 |
| 153,206 | 9/1951 | Australia | 8/133 |
| 423,711 | 5/1967 | Switzerland. | |

OTHER PUBLICATIONS

Tech. of Textile Industry, USSR, No. 3, 1969, pp. 91–95.

Chemical Abstracts, vol. 81, pp. 76–77, 1974.

Schmidlin, H. U., *Preparation and Dyeing of Synthetic Fibres,* pp. 398–399, Chapman & Hall Ltd., London 1963.

Alexander P. et al., Wool: Its Chemistry & Physics (AU 144), Reinhold Publ. Corp., N.Y. 1954, pp. 48–50.

*Primary Examiner*—Joseph L. Schofer
*Assistant Examiner*—Maria S. Tungol
*Attorney, Agent, or Firm*—Edward McC. Roberts; Prabodh I. Almaula

[57] ABSTRACT

A process for the dyeing of wool-containing fibre materials with anionic dyes, which process comprises dyeing these materials in the presence of an optionally etherified N-methylolurea compound which serves as a wool protective agent.

13 Claims, No Drawings

PROCESS FOR THE DYEING OF WOOL-CONTAINING FIBRE MATERIALS

The invention relates to a process for the dyeing of wool-containing fibre materials with anionic dyes, which process comprises dyeing these materials in the presence of an optically etherified N-methylolurea. The optionally etherified N-methylolureas serve as wool protective agents.

The N-methylolureas can be used both as acyclic and, preferably, as cyclic compounds in the etherified or, preferably, unetherified form.

In the case of the etherified products, these are in particular lower alkyl ethers having, e.g., 1 to 4 carbon atoms in the alkyl group, such as the n-butyl, isobutyl, isopropyl, n-propyl, ethyl and, in particular, methyl ethers. Both completely etherified products and only partially etherified products can be used.

The process according to the invention is preferably performed in the presence of an N-methylolurea of the formula

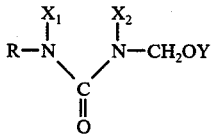

(1)

wherein R represents hydrogen, alkyl having 1 to 4 carbon atoms or $—CH_2OY_1$, $X_1$ and $X_2$ each represent hydrogen, alkyl having 1 to 4 carbon atoms or $—CH_2OY_2$, or $X_1$ and $X_2$ together represent alkylene having 2 or 3 carbon atoms, 1,2-dihydroxyethylene, 2-hydroxypropylene, 1-methoxy-2-dimethylpropylene, $—CH_2—O—CH_2$,

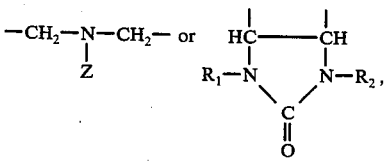

Y, $Y_1$ and $Y_2$ each represent hydrogen or alkyl having 1 to 4 carbon atoms, and Z represents hydrogen, alkyl or hydroxyalkyl each having 1 to 4 carbon atoms, and $R_1$ and $R_2$ each have the meaning given for R. The cyclic N-methylolurea compounds are preferred.

Suitable N-methylolureas are, for example, derivatives of urea, ethylene urea, propylene urea, acetylene diurea or dihydroxyethylene urea, as well as uron or triazone derivatives. Specific compounds which may be mentioned are: N,N'-dimethylolurea, N,N'-dimethylolurea-dimethyl ether, N,N'-tetramethylolacetylene diurea, N,N'-dimethylolpropylene urea, 4,5-dihydroxy-N,N'-dimethylolethylene urea, 4,5-dihydroxy-N,N'-dimethylolethylene urea dimethyl ether, N,N'-dimethylol-5-hydroxypropylene urea, 4-methoxy-5,5-dimethyl-N,N'-dimethylolpropylene urea, N,N'-dimethylol-5-oxapropylene urea and, in particular, N,N'-dimethylolethylene urea; and the cyclic urea compounds can in some cases be present also as oligo condensation products. It is also impossible to use mixtures of these acyclic and cyclic urea compounds.

Alkyl denoted by R, $X_1$, $X_2$, Y, $Y_1$, $Y_2$ and Z in the formula (1) is, for example, n-butyl, isobutyl, n-propyl, isopropyl or, in particular, ethyl and especially methyl.

Especially suitable for the process are N-methylolureas of the formula

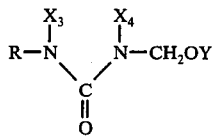

(2)

wherein $X_3$ and $X_4$ each represent hydrogen, alkyl having 1 to 4 carbon atoms or $—CH_2OY_2$, or $X_3$ and $X_4$ together represent alkylene having 2 or 3 carbon atoms or 1,2-dihydroxyethylene, and R, Y, $Y_1$ and $Y_2$ have the aforegiven meanings. $X_3$ and $X_4$ together can advantageously also represent 2-hydroxypropylene.

In the foreground of interest are N-methylolureas of the formula

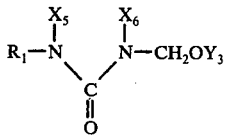

(3)

wherein $R_1$ represents hydrogen, methyl, ethyl, $—CH_2OH$ or $—CH_2OCH_3$, $X_5$ and $X_6$ each represent hydrogen, methyl, ethyl, $—CH_2OH$, or $X_5$ and $X_6$ together represent ethylene, 1,2-dihydroxyethylene or 2-hydroxypropylene, and $Y_3$ represents hydrogen or methyl, with the unetherified N-methylolureas being preferred.

Good results are obtained, in particular, with cyclic N-methylolureas of the formula

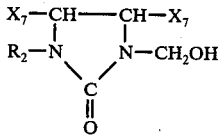

(4)

wherein $X_7$ represents hydrogen or hydroxyl, and $R_2$ represents hydrogen or preferably $—CH_2OH$; or are obtained especially with N,N'-dimethylolethylene urea.

The N-methylolureas to be used according to the invention are known and are produced by known methods. They are used according to the invention principally as a fibre protective agent for the wool which, as is known, does not withstand high temperatures without damage to the fibres occurring. The amounts in which the N-methylolureas are added to the dye baths vary between 0.5 and 10 percent by weight, preferably 1 and 6 percent by weight, relative to the weight of the material being dyed.

To be mentioned as wool-containing fibre material which can be dyed according to the invention is wool on its own or mixtures of wool and polyamide and particularly of wool and polyester, with mixtures of wool and synthetic polyamide being dyed with anionic dyes, and mixtures of wool and polyester fibres being dyed with disperse dyes and anionic dyes.

The fibre material can be in various stages of processing, e.g. in the form of yarn, flocks, slubbing, looped fabric such as knitted goods, or fibre fleece material or preferably in the form of fabric.

The blended fibre materials to be dyed are preferably fibre mixtures of wool and polyester, which as a rule have a ratio of 20 to 50 parts of wool to 50 to 80 parts of polyester. The fibre mixture preferably contains 45 parts of wool and 55 parts of polyester fibres.

Suitable polyester material is, in particular, fibre material made from linear polyesters, which are obtained, for example, by polycondensation of terephthalic acid with ethylene glycol, or of isophthalic acid or terephthalic acid with 1,4-bis(hydroxymethyl)-cyclohexane; or which are copolymers formed from terephthalic acid and isophthalic acid and ethylene glycol.

The anionic dyes used are, for example, salts of heavy-metalcontaining or, preferably, metal-free mono-, dis- or polyazo dyes, including the formazan dyes as well as the anthraquinone, xanthene, nitro, triphenylmethane, naphthoquinoneimine and phthalocyanine dyes. Of interest are also the 1:1- and 1:2-metal-complex dyes. The anionic character of these dyes can be induced by metal-complex formation alone and/or preferably by acid salt-forming substituents, such as carboxylic acid groups, sulphuric acid ester groups and phosphonic acid ester groups, phosphonic acid groups or sulphonic acid groups. These dyes can contain in the molecule also so-called reactive groupings which form with the wool constituent to be dyed a covalent bond. The so-called acid dyes are preferred.

Suitable disperse dyes according to the process are the difficultly water-soluble dyes known with regard to the dyeing of fibre materials made from linear polyesters, which dyes as a rule contain no water-solubilising groups and are present in the dye liquor in the form of a fine dispersion. These dyes can belong to the most varied classes of dyes; for example they can be acridone, azo, anthraquinone, coumarin, perinone, quinophthalone, styryl or nitro dyes.

Polyester/wool blended fibre materials are dyed according to the invention preferably with commercial mixtures of anionic dyes and disperse dyes.

The amount of dyes added to the liquor depends on the depth of colour desired; in general, amounts of 0.1 to 10 percent by weight, relative to the fibre material used, have proved to be satisfactory.

The dye baths can contain mineral acids such as sulphuric acid or phosphoric acid, organic acids, advantageously lower aliphatic carboxylic acids such as formic acid, acetic acid or oxalic acid, and/or salts such as ammonium acetate, ammonium sulphate or, preferably, sodium acetate. The acids serve principally to effect the adjustment of the pH value of the liquors used according to the invention, which value as a rule is 4 to 6.5, preferably 5.2 to 5.8.

In the dyeing of polyester/wool blended fibre materials, the dye baths can contain, besides the dyes and the wool protective agent, also a carrier or carrier mixtures, which act as dyeing accelerators for the dyeing of the polyester constituent. The following may be mentioned as examples of carriers to be concomitantly used if required: phenylphenols, benzylphenols, polychlorobenzenes, xylenes, trimethylbenzenes, naphthalenes, diphenyl, alkylbenzoates, arylbenzoates, dimethylphthalate, benzyl alcohol, mono-, di- and trichlorophenoxyethanol or mono-, di- and trichlorophenoxypropanol or pentachlorophenoxyethanol.

The dye baths can contain 0.1 to 5 g/l, preferably 0.5 to 3 g/l, of the carrier.

Furthermore, the dye baths can also contain dispersing agents, preferably anionic or nonionic dispersing agents. These serve above all to effect a good fine-dispersion of the disperse dyes. Suitable dispersing agents are those generally employed in dyeing with disperse dyes.

The dye baths can additionally contain the customary electrolytes, levelling agents, wetting agents and defoaming agents. The wool protective agent, together with a wetting agent, e.g. a mixture of a fatty alkyl sulphonate, a fatty alkyl polyglycol ether and a silicone defoaming agent, can if required be dissolved in water before being added to the dye bath.

The ratio of goods to liquor can be chosen within a wide range, e.g. 1:1 to 1:100, preferably 1:10 to 1:5.

The process according to the invention can be performed at temperatures of 60° to 130° C.

If the material to be dyed is wool on its own, the dyeing is advantageously performed by the exhaust process, e.g. at a temperature in the range of 60° to 106° C, preferably 95° to 98° C. The duration of dyeing can vary depending on the requirements; preferably however it is between 60 and 120 minutes. Under certain circumstances, this dyeing time may also be considerably exceeded where shade or levelling problems occur.

The dyeings of the polyester/wool blended fibre materials are performed with advantage in a single bath from an aqueous liquor and by the exhaust process. The materials are preferably dyed by the so-called high-temperature processes in closed pressure-tight apparatus at temperatures above 100° C, advantageously between 110° and 125° C, preferably at 118°–120° C., and optionally under pressure. Suitable closed vessels are, for example, circulation machines, such as cheese dyeing machines, beam dyeing machines, winch vats, nozzle dyeing machines, drum dyeing machines, paddle dyeing machines or jig dyeing machines.

These blended fibre materials can also be dyed by the usual carrier dyeing processes at temperatures below 106° C., e.g. in the temperature range of 75° to 98° C., in the presence of the aforementioned carriers or carrier mixtures.

The dyeing of the polyester/wool blended fibre materials can be performed by a process wherein the material to be dyed is firstly treated with the wool protective agent and optionally with the carrier and subsequently dyed. The procedure may also be such that the material to be dyed is treated simultaneously with the wool protective agent, the dyes and any auxiliaries required. The textile blended fibre material is preferably introduced into a liquor having a temperature of 40° to 50° C., and is treated at this temperature for 5 to 15 minutes. The dyes are then added at 60° to 70° C. and the temperature of the liquor is slowly raised for dyeing to be performed in the given temperature range for 20 to 60 minutes, preferably for 30 to 45 minutes.

The liquor is finally cooled to about 60° C., and the dyed material is rinsed and dried in the customary manner. The dyeing can if necessary be subjected to a normal subsequent washing.

There are obtained by the process according to the invention level and deeply coloured dyeings which are characterised also by good fastness to rubbing and by good dye yields. There is obtained in particular, with prolonged dyeing times both under normal conditions of temperature and in the high temperature range, a pronounced protection of the wool. Moreover, the other fastness properties of the dyeings, such as fastness to light and fastness to wet processing, are not affected by the use of the N-methylolureas as wool protective agents.

In the dyeing of blended fabrics made from wool and polyester fibres, it is now possible to obtain tone-in-tone dyeings at high temperature with a fully satisfactory protection of the wool constituent with conservation of the important 'fibre-technological' properties of the wool, such as ultimate tensile strength, resistance to bursting, and elongation. Compared with the conventional carrier method of dyeing at 98° to 106° C., the dyeing, according to the invention, of the polyester/-wool blended fibre materials at high temperature offers the additional advantage of a shortening of the dyeing time and a saving of carrier material. Depending on the depth of colour and on the affinity of the polyester constituent, dyeing can be performed at elevated temperatures without carriers, so that contamination of the waste-liquor and of the air is less. By virtue of the improved migration capacity of the disperse dyes, there is also obtained with the new method of dyeing a better levelness of the dyeings.

Compared with formaldehyde or formaldehyde-containing preparations as known wool protective agents, the new wool protective agents are characterised by a significantly less generation of smell and also by a better stability compared with electrolytes customarily present in the dye bath, such as ammonium salts, and by less yellowing of the dyed material as a result of exposure to light.

In the following Examples, percent denotes percent by weight and parts denote parts by weight.

EXAMPLE 1

25 g of a blended fabric consisting of 55% of polyester and 45% of wool is treated in a circulation dyeing apparatus for 5 minutes at 40° C. with a liquor which contains 0.5 g of N,N'-dimethylolethylene urea, 0.125 g of sulphated fatty amine polyglycol ether, 0.125 g of sulphated fatty amine polyglycol ether, 0.38 g of a mixture of trichlorobenzene and diphenyl (2:1), 0.66 g of sodium acetate in 300 ml of water, the pH of this liquor having been adjusted to 5.5 with acetic acid. The liquor is then heated to 120° C. within 30 minutes, in the course of which there is added at 70° C.

0.5 g of a dye mixture consisting of:

1.6 parts of a dye of the formula

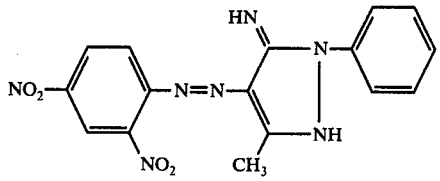

(11), 60.0 parts of a dye of the formula

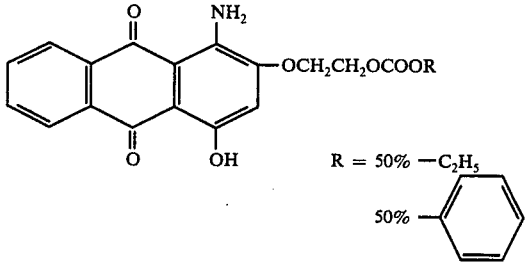

(12), 5.0 parts of a dye of the formula

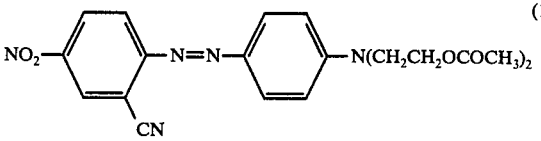

(13), 4.0 parts of a dye of the formula

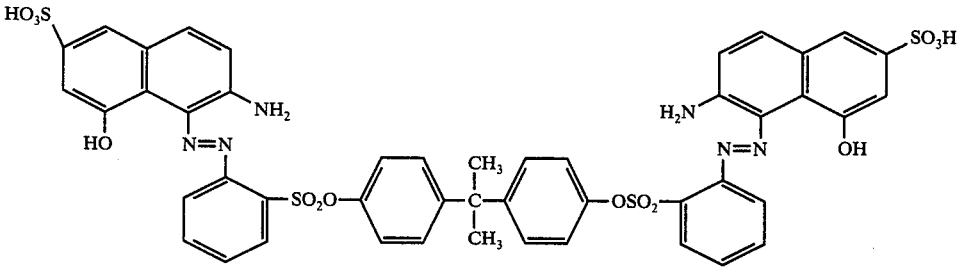

(14), 3.3 parts of a dye of the formula

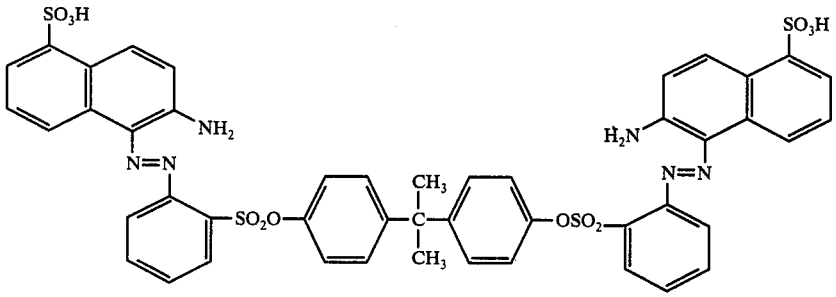

(15), 15 parts of a dye of the formula

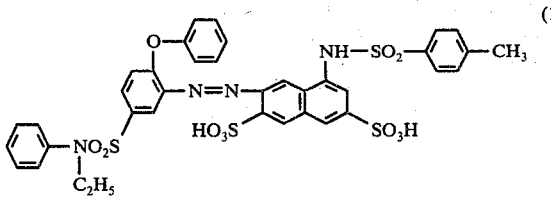

(16)

and 11 parts of Glauber's salt. Dyeing is subsequently performed for 40 minutes at 120° C. and the liquor is then cooled to 60° C. The customary washing treatment is afterwards carried out, and the resulting dyeing is rinsed and dried. A level red, tone-in-tone dyeing having fastness to rubbing is obtained without loss of wool quality.

If N,N'-dimethylol-4,5-dihydroxyethylene urea or N,N'-dimethylolurea is used instead of N,N'-dimethylolethylene urea, under otherwise the same conditions, a good protection of the wool is likewise obtained.

EXAMPLE 2

100 g of a blended fabric consisting of 55% of polyester and 45% of wool is treated in a circulation dyeing apparatus for 15 minutes at 60° C. with a liquor which contains 2.0 g of N,N'-dimethylolethylene urea,
1.0 g of a sulphated fatty amine polyglycol ether,
6.0 g of a mixture of trichlorobenzene and diphenyl (2:1) in 2000 ml of water. To the liquor are then added
4.0 g of ammonium sulphate and 4.0 g of the dye mixture given in Example 1; and the pH value of the dye bath is brought to 5.5 with formic acid. The liquor is subsequently heated within 45 minutes to 98° C. and the material is dyed for 120 minutes at this temperature. The dye liquor is afterwards cooled and the dyed material is washed, rinsed and dried in the customary manner.

A level red, tone-in-tone dyeing having fastness to rubbing is obtained without loss of wool quality.

EXAMPLE 3

25 g of a wool fabric is treated for 10 minutes at 50° C. with a liquor which contains 1 g of ammonium sulphate,
0.5 g of N,N'-dimethylolethylene urea, and
0.125 g of a naphthalenesulphonic acid condensation product, dissolved in 500 ml of water, the pH value of this liquor having been adjusted to 6 with acetic acid. There is then introduced 0.75 g of a dye of the formula

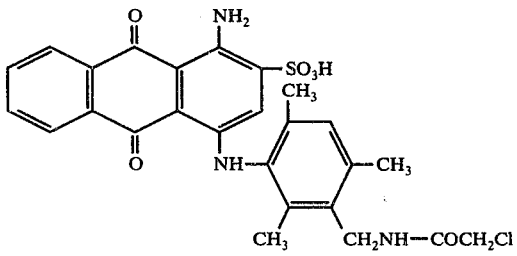

(17), and the material is treated for 5 minutes. The dye liquor is subsequently heated to 98° C. within 45 minutes, and the wool fabric is dyed for 60 minutes at this temperature. The liquor is afterwards cooled and the fabric is rinsed and dried in the usual manner.

There is thus obtained a level blue dyeing having fastness to rubbing, without any unfavourable effect on the quality of the wool.

EXAMPLE 4

25 g of a blended fabric consisting of 55% of polyester and 45% of wool is treated for 5 minutes at 40° C. in a circulation dyeing apparatus with a liquor which contains 0.5 g of N,N'-dimethylolethylene urea,
0.125 g of a sulphated fatty amine glycol ether,
0.38 g of a mixture of trichlorobenzene and diphenyl (2:1) (2:1), and
0.66 g of sodium acetate, in 300 ml of water, the pH of which has been brought to 5.5 with acetic acid. The liquor is then heated to 120° C. within 30 minutes, in the course of which there is added to the liquor at 70° C.

0.5 g of a dye mixture composed of
20 parts of a dye of the formula (17),
20 parts of disperse blue 56 C.I. 63285,
10 parts of disperse blue 19 C.I. 61110,
20 parts of a dye of the formula

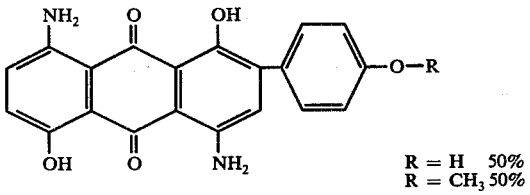

(18)

R = H 50%
R = $CH_3$ 50% and 25 parts of Glauber's salt. Dyeing is performed for 40 minutes at 120° C. and the liquor is subsequently cooled to 60° C.; the customary washing treatment is afterwards carried out. The resulting dyeing is rinsed and dried. A level blue, tone-in-tone dyeing having fastness to rubbing is obtained without loss of wool quality.

If 4,5-dihydroxy-N,N'-dimethylolethylene urea, N,N'-dimethylolurea, N,N'-dimethylolpropylene urea, N,N'-dimethylol-5-hydroxypropylene urea or N,N'-dimethylolurea-dimethyl ether is used instead of 4,5-dihydroxy-N,N'-dimethylolethylene urea, under otherwise the same conditions, there is likewise obtained a good protection of the wool.

We claim:

1. A process for the dyeing of wool-containing fibers, selected from the group consisting of wool and polyester/wool blend comprising the step of treating the fibers in the temperature range of 95° to 125° C. with a dye liquor comprising an anionic dye and a cyclic N-methylolurea compound which is etherified or unetherified.

2. The process of claim 1, wherein the cyclic N-methylolurea compound is of the formula

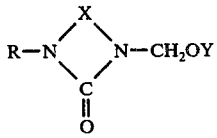

wherein

X is alkylene of 2 or 3 carbon atoms, 1,2-dihydroxyethylene, 2-hydroxypropylene, 1-methoxy-2-dimethylpropylene, $—CH_2—O—CH_2$,

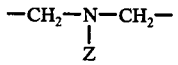

or

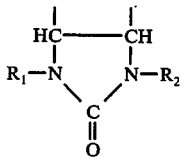

R, $R_1$ and $R_2$ are each hydrogen, alkyl of 1 to 4 carbon atoms or $—CH_2OY_1$, Y, and $Y_1$ are each hydrogen or alkyl of 1 to 4 carbon atoms, and Z is hydrogen, alkyl of 1 to 4 carbon atoms or hydroxyalkyl of 1 to 4 carbon atoms.

3. The process of claim 2, wherein X is alkylene of 2 or 3 carbon atoms, 1, 2-dihydroxyethylene, or 2-hydroxypropylene.

4. The process of claim 3, wherein X is 2-hydroxypropylene.

5. The process of claim 3, wherein

R is hydrogen, methyl, ethyl, hydroxymethyl, or methoxymethyl,

Y is hydrogen or methyl and

X is ethylene, 1,2-dihydroxyethylene or 2-hydroxypropylene.

6. The process of claim 5, wherein

Y is hydrogen,

R is hydrogen or hydroxymethyl, and

X is ethylene or 1, 2-dihydroxyethylene.

7. The process of claim 6, wherein R is hydroxymethyl and X is ethylene.

8. The process of claim 1, wherein the dye liquor contains the cyclic N-methylolurea compound in an amount of 0.5 to 10 percent by weight, relative to the weight of the fibers.

9. The process of claim 8 wherein the dye liquor contains the cyclic N-methylolurea compound in an amount of 1 to 6 percent by weight.

10. The process of claim 1, wherein the wool-containing fibers are a blend of polyester/wool, and wherein the dye liquor further comprises a disperse dye.

11. The process of claim 10, wherein the fibers are treated with the dye liquor at a temperature of 110° to 125° C.

12. The process of claim 10, wherein the temperature is in the range of 118° to 120° C.

13. The process of claim 10, wherein the dye liquor further comprises a carrier or a carrier mixture.

* * * * *